US009044093B1

(12) United States Patent
Pan

(10) Patent No.: US 9,044,093 B1
(45) Date of Patent: Jun. 2, 2015

(54) HEIGHT-ADJUSTABLE HANDREST

(71) Applicant: Oasyschair Co., Ltd., Tainan (TW)

(72) Inventor: Toung-Chun Pan, Tainan (TW)

(73) Assignee: Oasyschair Co., Ltd., Tainan (TW)

( * ) Notice: Subject to any disclaimer, the term of this patent is extended or adjusted under 35 U.S.C. 154(b) by 0 days.

(21) Appl. No.: 14/274,799

(22) Filed: May 12, 2014

(51) Int. Cl.
*A47C 7/54* (2006.01)
*B60N 2/46* (2006.01)
*A47C 1/03* (2006.01)

(52) U.S. Cl.
CPC .... *A47C 1/03* (2013.01); *A47C 7/54* (2013.01)

(58) Field of Classification Search
CPC ..... A47C 7/54; A47C 1/03
USPC ..... 297/411.36, 411.2, 411.31
See application file for complete search history.

(56) References Cited

U.S. PATENT DOCUMENTS 5,318,347 A * 6/1994 Tseng ..... 297/411.36
5,620,233 A * 4/1997 Corwin ..... 297/411.36
5,769,497 A * 6/1998 Tsai ..... 297/411.36
5,975,634 A * 11/1999 Knoblock et al. ..... 297/300.4
6,336,680 B1 * 1/2002 Lee ..... 297/411.36
6,419,323 B1 * 7/2002 Chu et al. ..... 297/411.36
7,533,939 B2 * 5/2009 Fookes et al. ..... 297/411.36
7,556,316 B1 * 7/2009 Lai ..... 297/411.36
7,980,632 B2 * 7/2011 Pai ..... 297/411.36
8,128,172 B2 * 3/2012 Tsai ..... 297/411.36
8,128,309 B2 * 3/2012 Tsai ..... 403/322.1
8,777,318 B2 * 7/2014 Chen ..... 297/411.36
2007/0164595 A1 * 7/2007 Chi ..... 297/411.36
2010/0244531 A1 * 9/2010 Pai ..... 297/411.36
2011/0221251 A1 * 9/2011 Tsai ..... 297/411.36
2011/0248542 A1 * 10/2011 Tsai ..... 297/411.36
2012/0104823 A1 * 5/2012 Lai ..... 297/411.36

* cited by examiner

*Primary Examiner* — Chi Q Nguyen
(74) *Attorney, Agent, or Firm* — Alan D. Kamrath; Kamrath IP Lawfirm, P.A.

(57) ABSTRACT

A height-adjustable handrest has constituent components describe below. A middle bar element is inserted into a handrest external bar and has an internal space for containing a spring and an inner bar element. The handrest external bar is enclosed by a support unit with an upper end pivotally coupled to a press element. The press element has one end abutting against the inner bar element and has the other end protruding under an upward thrust from the spring. A pin passing through slots formed at the handrest external bar to penetrate oblong holes disposed at the inner bar element and the middle bar element, respectively. When pressed, the press element drives the inner bar element to move downward, thereby moving the pin upward along the inclined oblong hole of the inner bar element, compressing the spring downward, and moving the pin into a longitudinal channel of the handrest external bar.

4 Claims, 9 Drawing Sheets

HEIGHT-ADJUSTABLE HANDREST

BACKGROUND OF THE INVENTION

1. Technical Field

The present invention relates to height-adjustable handrests, and more particularly, to a height-adjustable handrest mounted on each of the two sides of a chair and designed to render element processing simpler, element assembly easier and faster, and element processing cost lower.

2. Description of Related Art

To enable users to conveniently adjust the height of conventional handrests mounted on two sides of a chair, a height-adjustment mechanism varies in shape from handrest to handrest, so that the users can operate the height-adjustment mechanism easily with a view to lifting or lowering the handrests as expected and then fixing the handrests in place precisely.

The typical height-adjustment mechanism of the conventional handrests of a chair comprises: two supporting base portions disposed on two sides of the chair, respectively; handrest coupling elements adapted to enclose the supporting base portions, respectively, and capable of ascending and descending freely; and a switching unit disposed between the handrest coupling element and the supporting base portion and adapted to effectuate positional restriction on movement of the handrest coupling elements or release the handrest coupling elements as needed, wherein the handrest coupling elements and handrests mounted thereon can undergo height adjustment within a predetermined range, and a control element of the switching unit is released as soon as the required height of the handrest coupling elements and handrests is attained, thereby allowing the handrests to be mounted and positioned in place precisely.

In view of this, the present invention puts forth a novel design different from the aforesaid conventional height-adjustable handrest in terms of assembly, such that the height-adjustable handrest of the present invention is designed to render element processing simpler, element assembly easier and faster, and element processing cost lower.

BRIEF SUMMARY OF THE INVENTION

The present invention puts forth a novel design different from conventional height-adjustable handrests in element processing or assembly. The height-adjustable handrest of the present invention is characterized in that: a middle bar element is inserted into a handrest external bar; the middle bar element has an internal space for containing a spring and an inner bar element; the handrest external bar is enclosed by a support unit with an upper end pivotally coupled to a press element; the press element has one end abutting against an upper end of the inner bar element and has the other end protruding under an upward thrust from the spring; a user presses the press element to cause the inner bar element to move downward, and a pin penetratingly disposed at the inner bar element exits slots of the handrest external bar, such that the support unit coupled to one end of the middle bar element can undergo height adjustment as needed while being free from any restraint, and the user can release the press element so as to precisely position the handrests at a predetermined height.

It is an objective of the present invention to provide a height-adjustable handrest which comprise a handrest external bar, a middle bar element, an inner bar element, a support unit, a press element, a handrest pad. The handrest external bar is flanked by slots corresponding in position to each other and provided with a longitudinal channel disposed beside the slots. The middle bar element is inserted into the handrest external bar. An upper end of the middle bar element dents downward to form a space of a predetermined depth for containing a spring and the inner bar element. A horizontal oblong hole is disposed at a lower portion of the middle bar element, and an inclined oblong hole is disposed at a lower portion of the inner bar element, allowing a pin passing through the slots formed at the handrest external bar to penetrate the horizontal oblong hole of the middle bar element and the inclined oblong hole of the inner bar element, such that the inner bar element keeps sticking out resiliently. The support unit encloses the handrest external bar. The support unit has an upper end pivotally coupled to the press element in a manner to effectuate positional engagement between the support unit and the middle bar element. The press element has an end abutting against an upper end of the inner bar element and has another end protruding under an upward thrust of the spring. The upper end of the support unit is coupled to a handrest pad so as to form the height-adjustable handrest. A user presses the press element to move the inner bar element downward, not only allowing the pin penetratingly disposed at the middle bar element to go up the inclined oblong hole of the inner bar element to therefore press down the spring, but also allowing the pin to exit the slots of the handrest external bar and retreat to the longitudinal channel beside the slots, such that the support unit coupled to an end of the middle bar element undergoes height adjustment as needed while being free from any restraint. After the height-adjustable handrest has been positioned in place at a predetermined height, the user releases the press element to move the inner bar element upward under a restoring force of the spring, and thus the pin penetratingly disposed at the lower portion of the inner bar element moves laterally into a corresponding one of the slots disposed at the handrest external bar, thereby allowing the height-adjustable handrest to be easily operated and precisely positioned in place at a predetermined height.

Another objective of the present invention is to provide the height-adjustable handrest characterized in that: the handrest external bar has therein a space of a predetermined depth, and the space tapers toward an end thereof and thus is trapezoid so as to admit precisely the trapezoid inner bar element.

Yet another objective of the present invention is to provide the height-adjustable handrest characterized in that: the inner bar element, insertable into a space of a predetermined depth and at the upper end of the middle bar element, has an end extending to form a protruding portion insertable into a groove of a predetermined depth and at a corresponding portion of the middle bar element to effectuate adjustment of height within a preset range.

A further objective of the present invention is to provide the height-adjustable handrest characterized in that: the handrest external bar is enclosed by the support unit with an upper end coupled to the press element, as a receiving portion is disposed beside an opening at the upper end of the support unit to receive steadily two support portions extending from two sides of the press element, such that an end of the press element keeps abutting against the upper end of the inner bar element resiliently.

DETAILED DESCRIPTION OF THE INVENTION

Figure 1:
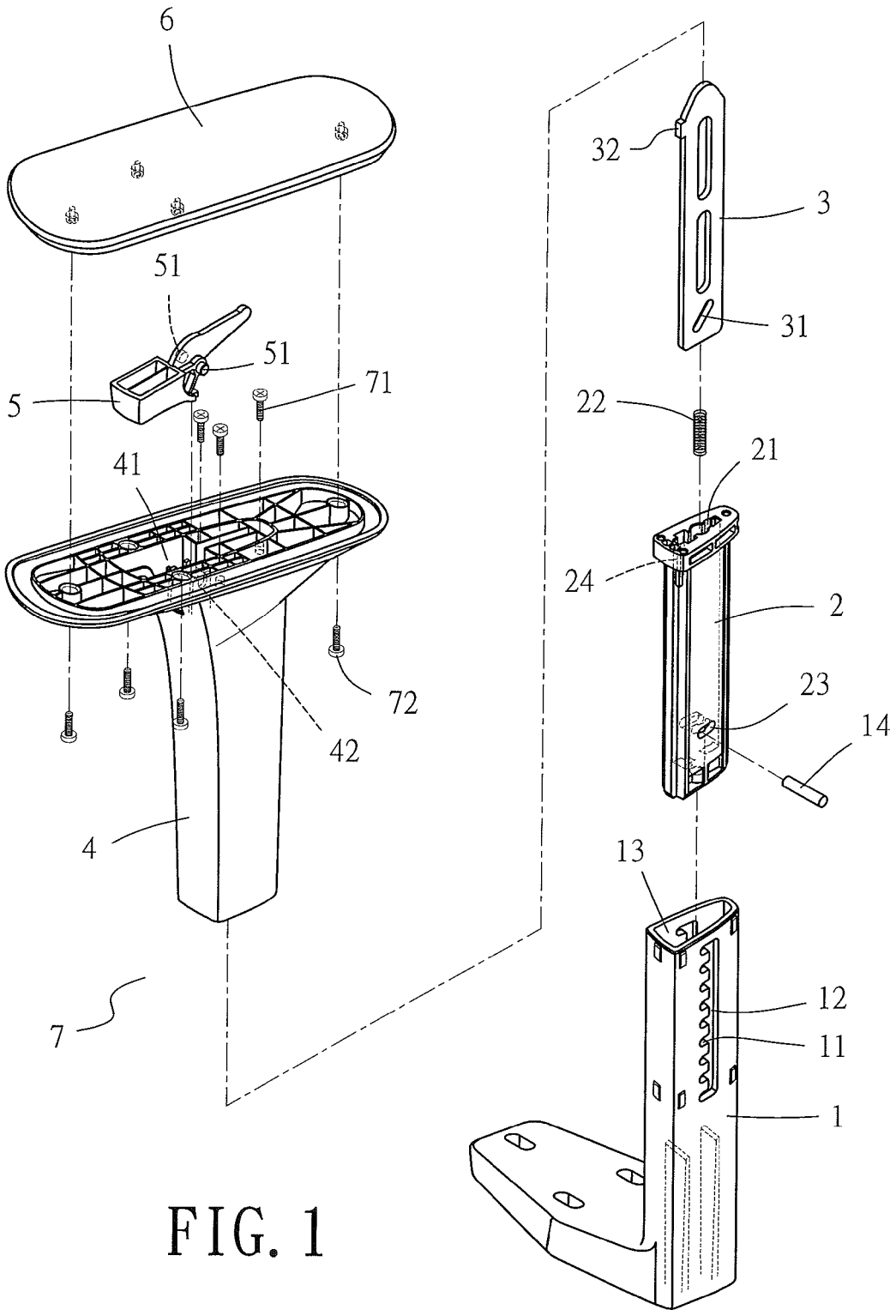
FIG. 1 is an exploded view of a height-adjustable handrest of the present invention.

Referring to FIG. 1, the present invention provides a height-adjustable handrest comprising a handrest external bar 1, a middle bar element 2, an inner bar element 3, a support unit 4, a press element 5, and a handrest pad 6.

Figure 2:
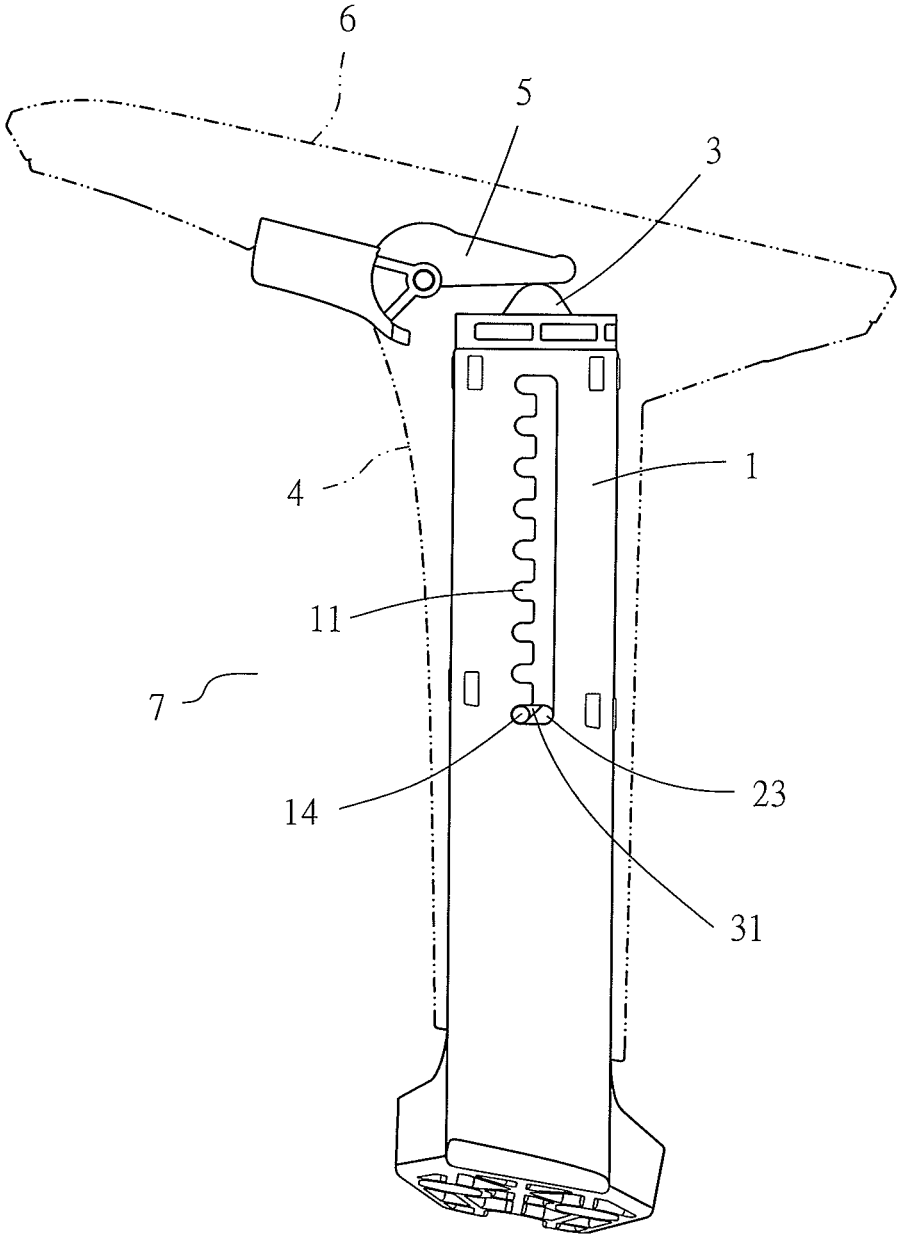
FIG. 2 is a schematic lateral view of the height-adjustable handrest of the present invention.
Figure 3:
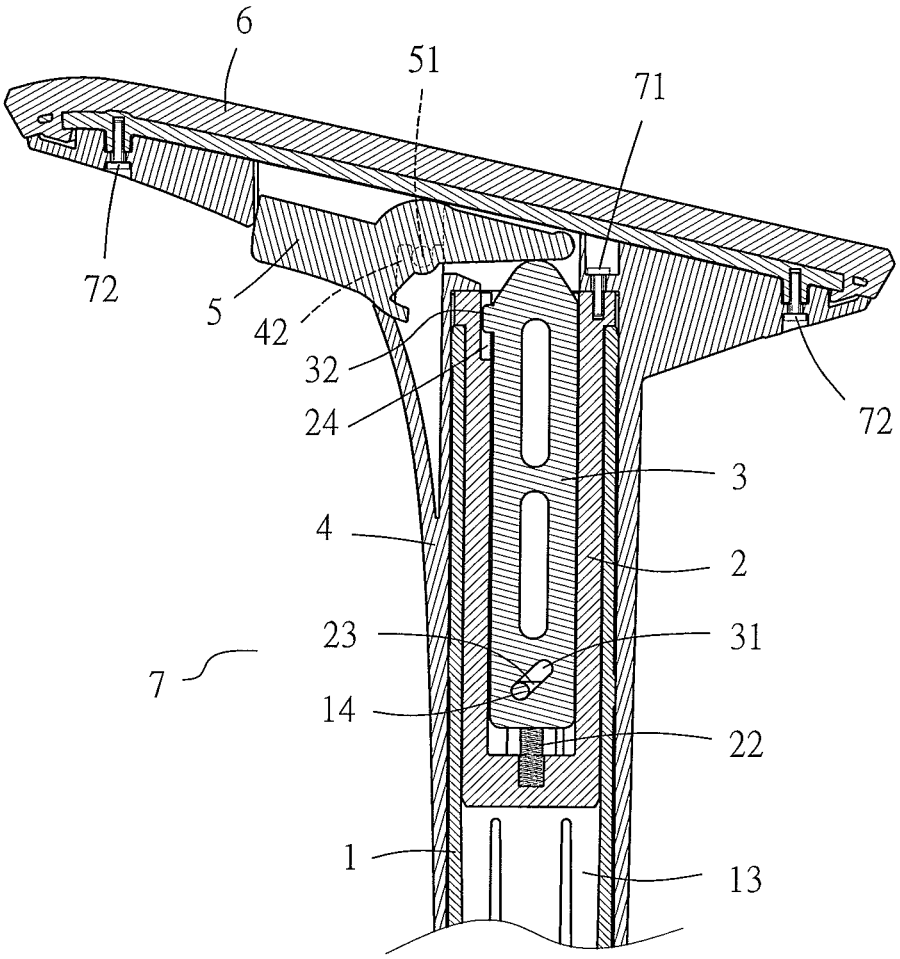
FIG. 3 is a partial front cross-sectional view of FIG. 2.

Slots 11 corresponding in position to each other are disposed on two sides of the handrest external bar 1. A longitudinal channel 12 is disposed beside the slots 11. The middle bar element 2 (as shown in FIG. 3) is inserted into the handrest external bar 1. The handrest external bar 1 has therein a space 13 of a predetermined depth. The space 13 tapers toward one end thereof and thus is trapezoid so as to admit precisely the inner bar element 3 which is also trapezoid. The upper end of the middle bar element 2 dents downward to form a space 21 of a predetermined depth. The space 21 contains a spring 22 and an inner bar element 3. The spring 22 is allowed to reach a considerable depth of the space 21. A horizontal oblong hole 23 is disposed at a lower portion of the middle bar element 2. An inclined oblong hole 31 is disposed at a lower portion of the inner bar element 3. A pin 14 passes through the slots 11 of the handrest external bar 1 to penetrate the horizontal oblong hole 23 of the middle bar element 2 and the inclined oblong hole 31 of the inner bar element 3 (as shown in FIG. 2), such that the inner bar element 3 keeps sticking out resiliently. The inner bar element 3, which is inserted into the space 21 of a predetermined depth and at the upper end of the middle bar element 2, has an end extending to form a protruding portion 32 insertable into a groove 24 of a predetermined depth and at a corresponding portion of the middle bar element 2 to effectuate adjustment of height within a preset range (as shown in FIG. 3). The handrest external bar 1 is enclosed by the support unit 4 with an upper end pivotally coupled to the press element 5. The upper end of the support unit 4 is coupled to the press element 5 in a manner characterized in that: a receiving portion 42 (as shown in FIG. 1) is disposed beside an opening 41 at the upper end of the support unit 4 and adapted to receive steadily two support portions 51 extending from two sides of the press element 5, respectively, (as shown in FIG. 3), such that an end of the press element 5 keeps abutting against the upper end of the inner bar element 3 to effectuate positional engagement between the support unit 4 and the middle bar element 2, wherein the engagement between the support unit 4 and the middle bar element 2 is achieved by a plurality of screwing elements 71. The press element 5 has an end abutting against the upper end of the inner bar element 3 and has the other end protruding under the upward thrust of the spring 22. The upper end of the support unit 4 is coupled to the handrest pad 6 so as to form a height-adjustable handrest 7. The engagement between the handrest pad 6 and the support unit 4 is effectuated by a plurality of screwing elements 72.

Figure 4:
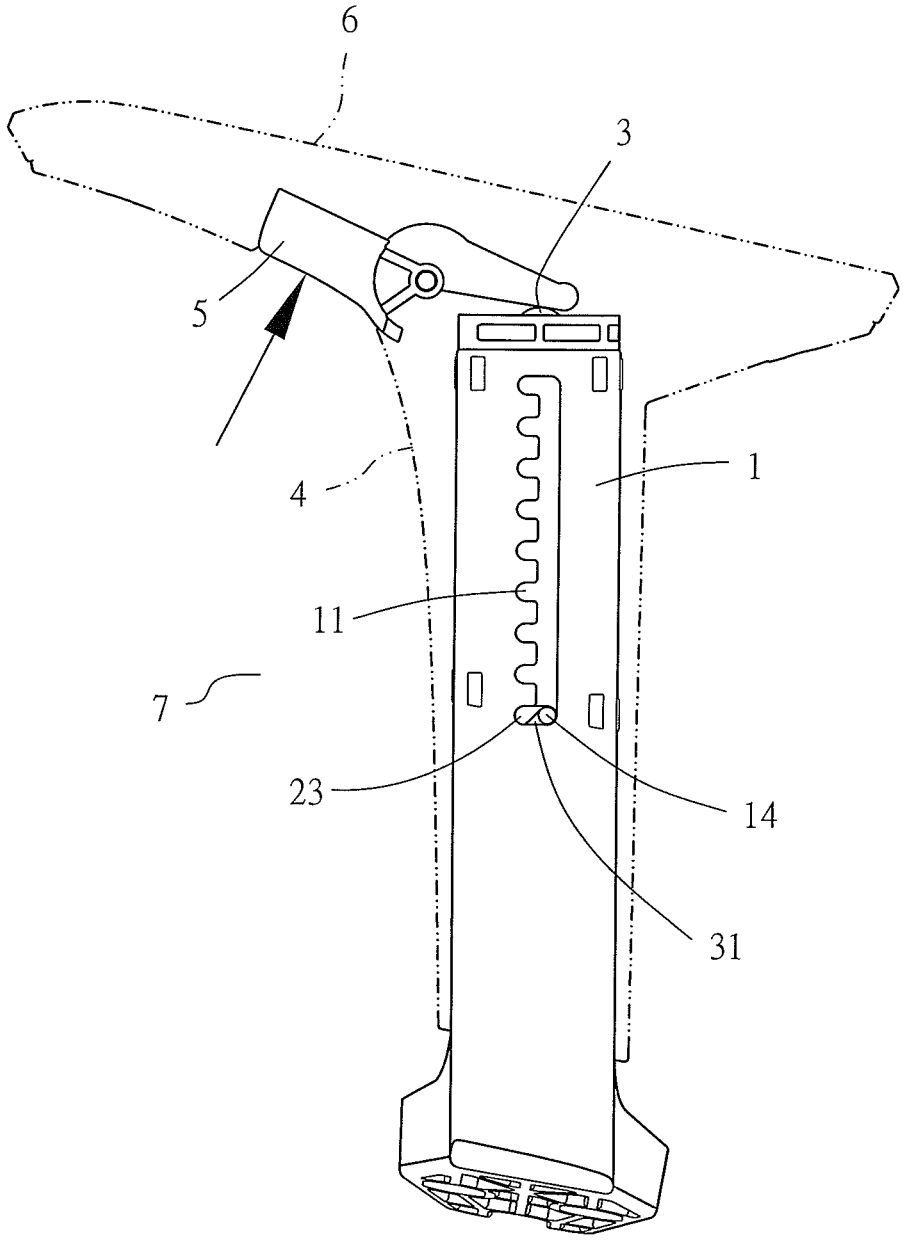
FIG. 4 is a press-related schematic view of the height-adjustable handrest prior to operation according to the present invention.
Figure 5:
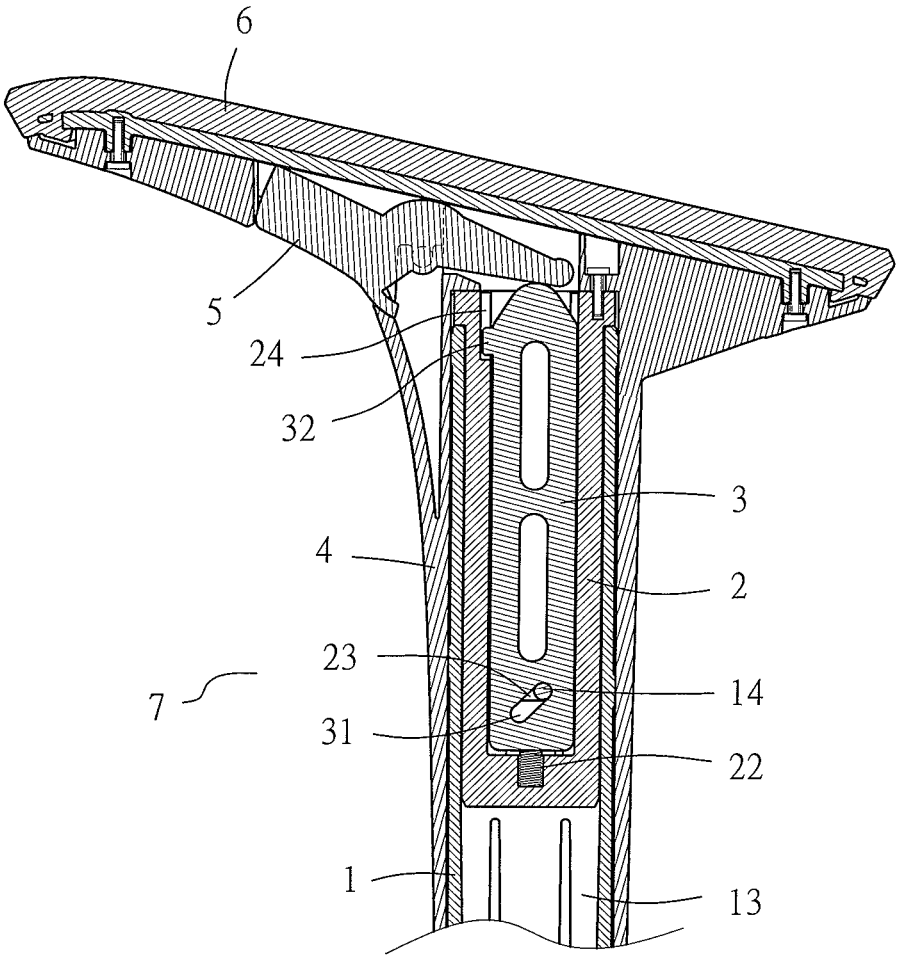
FIG. 5 is a partial front cross-sectional view of FIG. 4.
Figure 6:
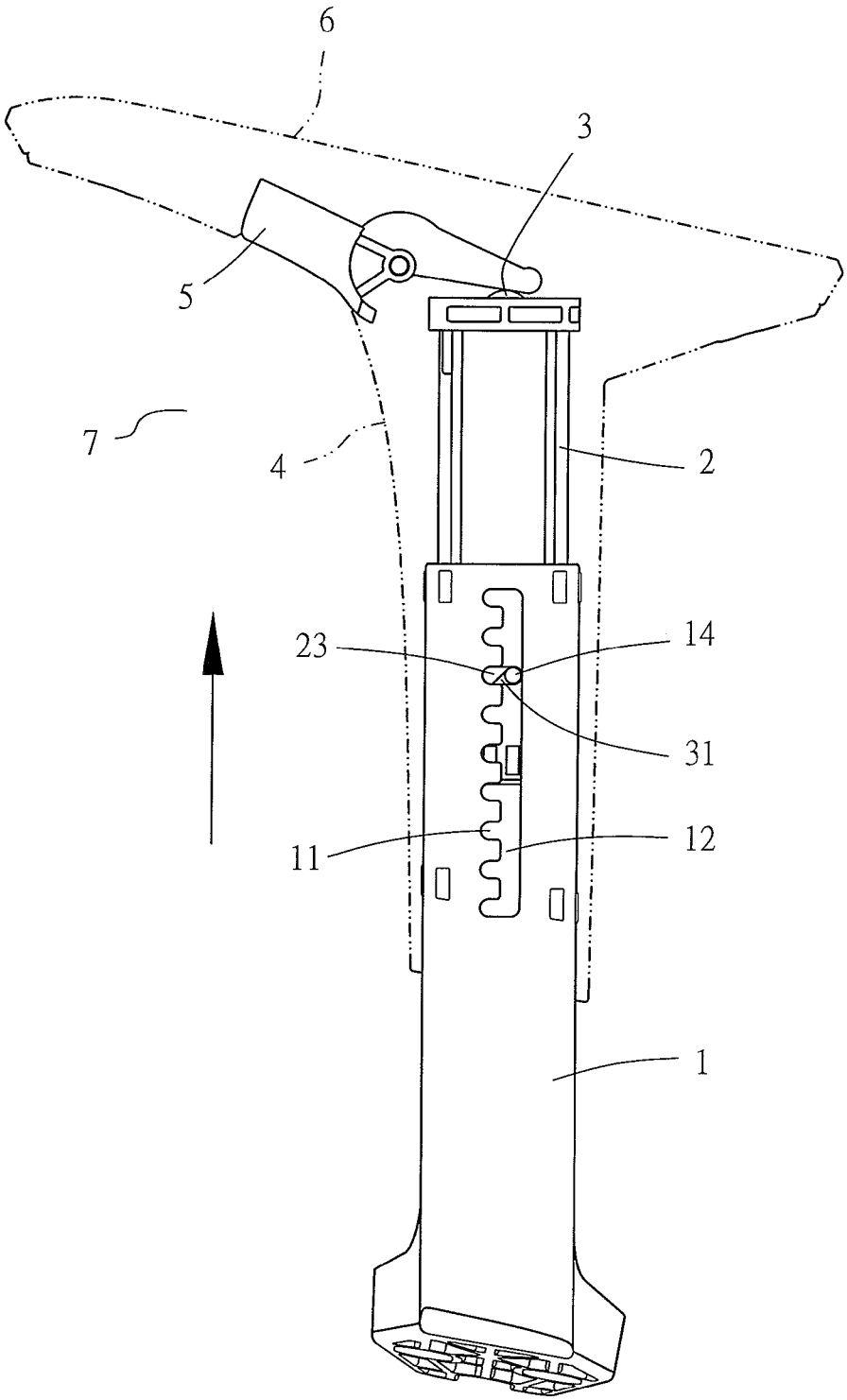
FIG. 6 is a schematic view of operation of the height-adjustable handrest moving upward according to the present invention.
Figure 7:
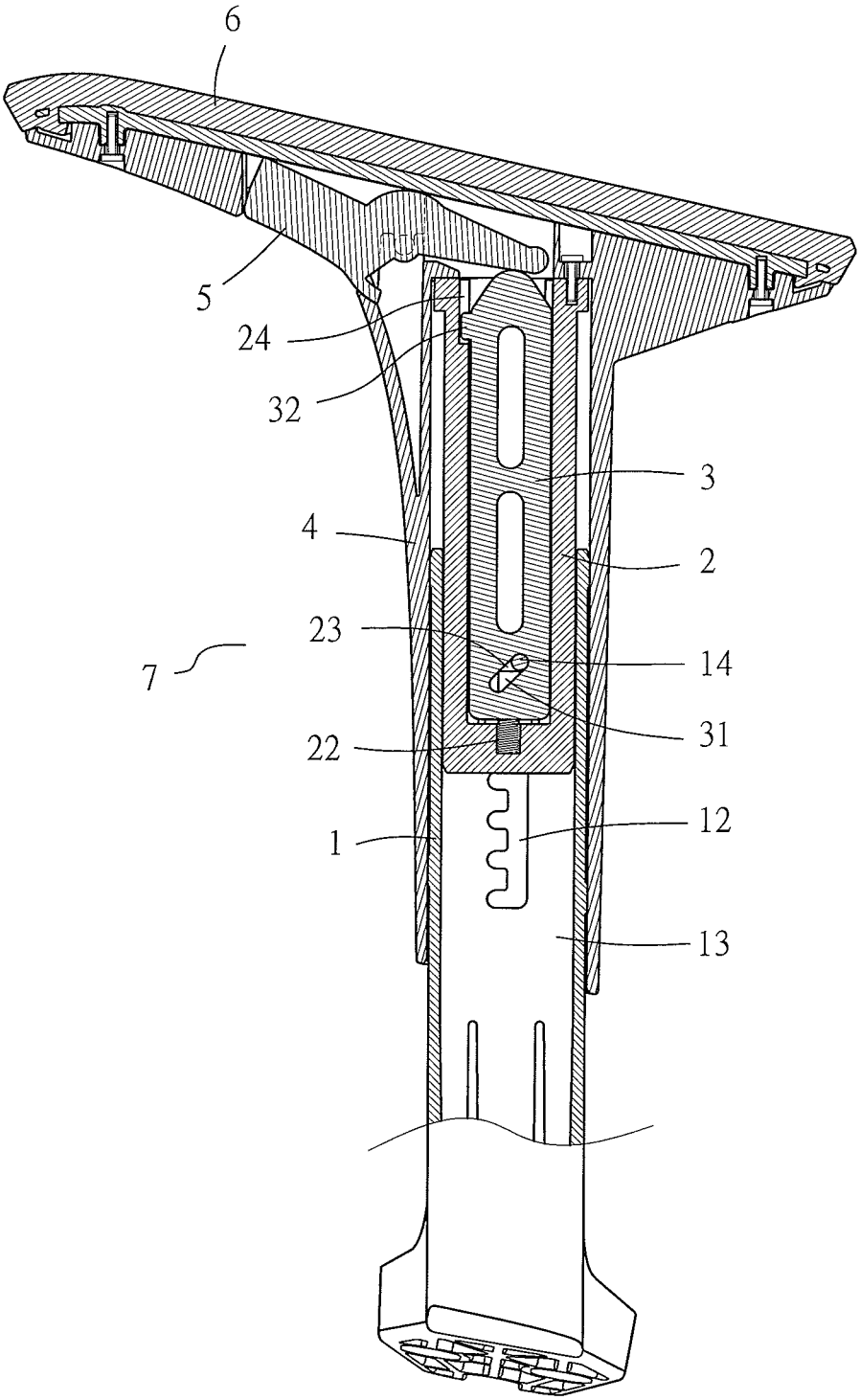
FIG. 7 is a front cross-sectional view of FIG. 6.
Figure 8:
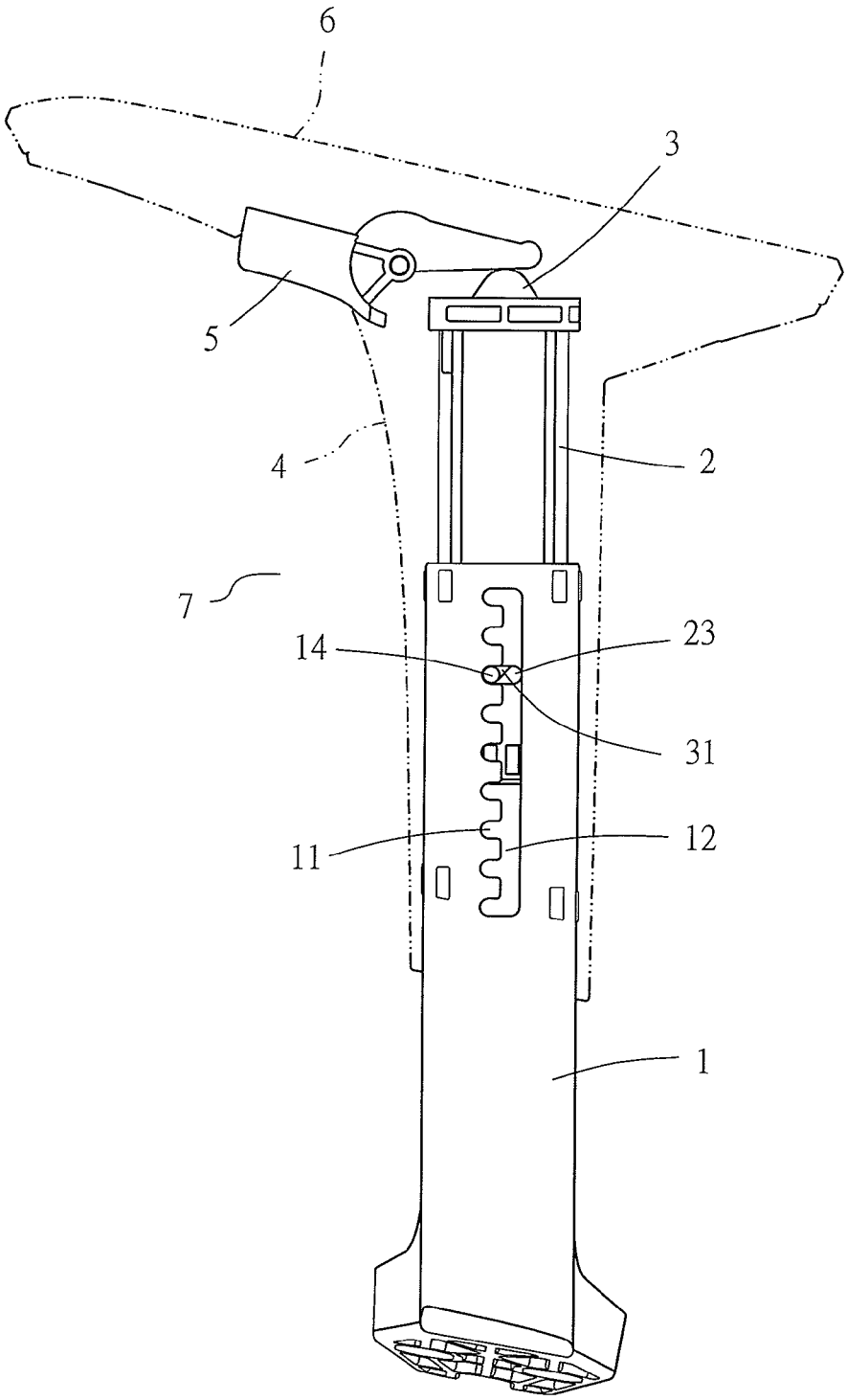
FIG. 8 is a schematic view of the height-adjustable handrest positioned in place when a press element thereof is released according to the present invention.
Figure 9:
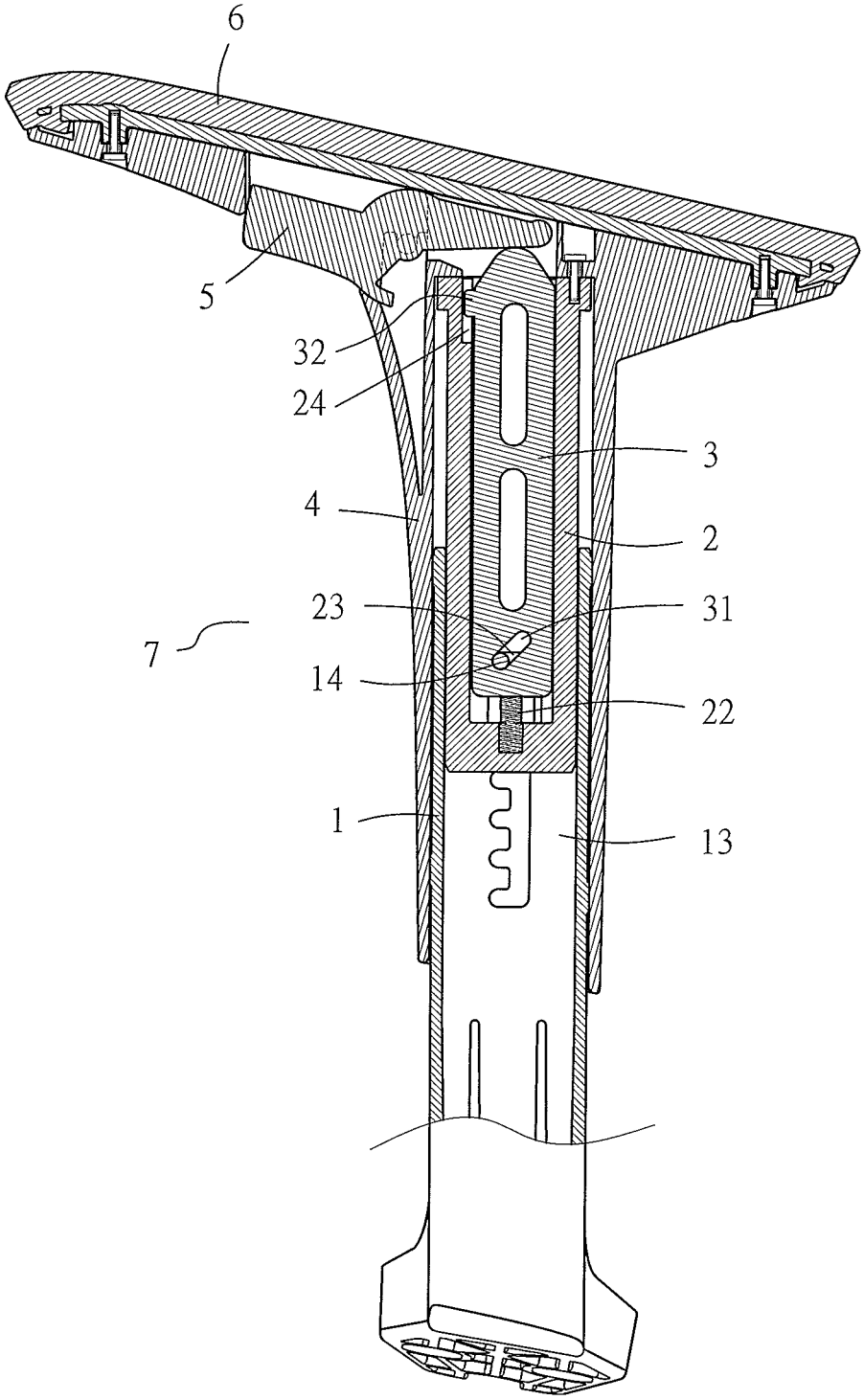
FIG. 9 is a partial front cross-sectional view of FIG. 8.

The process of adjusting the height of the height-adjustable handrest 7 to fix the height-adjustable handrest 7 in place at a predetermined height (as shown in FIGS. 4, 5) is described below. A user presses the press element 5 protruding laterally from the height-adjustable handrest 7 to cause the inner end of the press element 5 to abut downward against the inner bar element 3, and thus the inner bar element 3 moves downward. As a result, the pin 14 penetratingly disposed at the middle bar element 2 goes up the inclined oblong hole 31 of the inner bar element 3 and thus presses down the spring 22; meanwhile, the pin 14 exits the slots 11 of the handrest external bar 1 and retreats to the longitudinal channel 12 beside the slots 11, such that the support unit 4 coupled to an end of the middle bar element 2 can undergo height adjustment as needed while being free from any restraint (as shown in FIGS. 6, 7). After the height-adjustable handrest 7 has been positioned in place at a predetermined height, the user releases the press element 5 (as shown in FIGS. 8, 9) to move the inner bar element 3 upward under the restoring force of the spring 22, and thus the pin 14 penetratingly disposed at the lower portion of the inner bar element 3 moves laterally into a corresponding one of the slots 11 disposed at the handrest external bar 1.

Accordingly, the height-adjustable handrest of the present invention is advantageously characterized by ease of use and the precise positioning of the handrests at a predetermined height.

What is claimed is:

1. A height-adjustable handrest, comprising:

a handrest external bar flanked by slots corresponding in position to each other and provided with a longitudinal channel disposed beside the slots;

an inner bar element;

a middle bar element inserted into the handrest external bar, wherein an upper end of the middle bar element dents downward to form a space of a predetermined depth for containing a spring and the inner bar element, a horizontal oblong hole is disposed at a lower portion of the middle bar element, and an inclined oblong hole is disposed at a lower portion of the inner bar element, allowing a pin passing through the slots formed at the handrest external bar to penetrate the horizontal oblong hole of the middle bar element and the inclined oblong hole of the inner bar element, such that the inner bar element keeps sticking out resiliently;

a press element; and a support unit for enclosing the handrest external bar, the support unit having an upper end pivotally coupled to the press element in a manner to effectuate positional engagement between the support unit and the middle bar element, wherein the press element has an end abutting against an upper end of the inner bar element and has another end protruding under an upward thrust of the spring, and an upper end of the support unit is coupled to a handrest pad so as to form the height-adjustable handrest, wherein a user presses the press element to move the inner bar element downward, not only allowing the pin penetratingly disposed at the middle bar element to go up the inclined oblong hole of the inner bar element to therefore press down the spring, but also allowing the pin to exit the slots of the handrest external bar and retreat to the longitudinal channel beside the slots, such that the support unit coupled to an end of the middle bar element undergoes height adjustment as needed while being free from any restraint, wherein, after the height-adjustable handrest has been positioned in place at a predetermined height, the user releases the press element to move the inner bar element upward under a restoring force of the spring, and thus the pin penetratingly disposed at the lower portion of the inner bar element moves laterally into a corresponding one of the slots disposed at the handrest external bar, thereby allowing the height-adjustable handrest to be easily operated and precisely positioned in place at a predetermined height.

2. The height-adjustable handrest of claim 1, wherein the handrest external bar has therein a space of a predetermined depth, and the space tapers toward an end thereof and thus is trapezoid so as to admit precisely the trapezoid inner bar element.

3. The height-adjustable handrest of claim 1, wherein the inner bar element, insertable into a space of a predetermined depth and at the upper end of the middle bar element, has an end extending to form a protruding portion insertable into a groove of a predetermined depth and at a corresponding portion of the middle bar element to effectuate adjustment of height within a preset range.

4. The height-adjustable handrest of claim 1, wherein the handrest external bar is enclosed by the support unit with an upper end coupled to the press element, as a receiving portion is disposed beside an opening at the upper end of the support unit to receive steadily two support portions extending from two sides of the press element, such that an end of the press element keeps abutting against the upper end of the inner bar element resiliently.

* * * * *